US005996357A

United States Patent [19]

Park

[11] Patent Number: 5,996,357

[45] Date of Patent: Dec. 7, 1999

[54] SYSTEM FOR CHECKING AN INTERNAL TEMPERATURE OF A REFRIGERATOR BY USING A THERMOCHROMIC MEMBER

[75] Inventor: Hyun-Keun Park, Seoul, Rep. of Korea

[73] Assignee: Daewoo Electronics Co., Ltd., Rep. of Korea

[21] Appl. No.: 09/088,073

[22] Filed: Jun. 1, 1998

[51] Int. Cl.[6] ..... F25B 49/00

[52] U.S. Cl. ..... 62/125; 116/216; 374/141; 374/162

[58] Field of Search ..... 62/125, 126, 127, 62/129, 130; 116/216; 374/141, 149, 161, 162; 165/11.1; 236/94

[56] References Cited

U.S. PATENT DOCUMENTS 4,014,178 3/1977 Kells ..... 62/125 X
5,718,513 2/1998 Booth et al. ..... 116/216 X

*Primary Examiner*—Harry B. Tanner
*Attorney, Agent, or Firm*—Pennie & Edmonds LLP

[57] ABSTRACT

A system for checking an internal temperature of a refrigerator includes a thermochromic member on an external surface of the refrigerator. A heat transfer from an inside of the refrigerator to the thermochromic member is made through a duct formed through a wall of the refrigerator. Accordingly, depending upon a level of temperature inside the refrigerator, a color of the thermochromic member is changed or not, informing an user of a state of the refrigerator in operation.

12 Claims, 4 Drawing Sheets

SYSTEM FOR CHECKING AN INTERNAL TEMPERATURE OF A REFRIGERATOR BY USING A THERMOCHROMIC MEMBER

FIELD OF THE INVENTION

The present invention is directed to a refrigerator; and, more particularly, to a system for checking an internal temperature of the refrigerator by using a thermochromic member.

DESCRIPTION OF THE PRIOR ART

In a normal refrigeration system or refrigerator, separate thermometric sensors or the like are mounted therein to detect an internal temperature thereof. The information relating to such internal temperature from the thermometric sensors is displayed on an external environment of the refrigerator through, e.g., a microprocessor. This configuration enables an user or an operator to be informed of the internal temperature of the refrigerator without opening the refrigerator.

Such thermometric sensors, however, are expensive and therefore are not employed in popular or cheap models. In these models, the user usually open the refrigerator and feel the air inside the refrigerator to check if the refrigerator is operating normally.

SUMMARY OF THE INVENTION

It is, therefore, a primary object of the invention to provide a refrigerator incorporating therein a system capable of checking an internal temperature thereof by using a thermochromic member showing color changes in response to variation of an internal temperature thereof.

The above and other objects of the invention are accomplished by providing a system for checking an internal temperature of a refrigerator comprising: a thermochromic member positioned on an external surface of the refrigerator; and a heat transfer means for serving as a path for a heat transfer between said thermochromic member and inside of the refrigerator.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE PREFERRED EMBODIMENTS

A first and a second embodiments and a modification of the inventive temperature checking system for use in a refrigerator will be now described with reference to the accompanying drawings.

Figure 1:
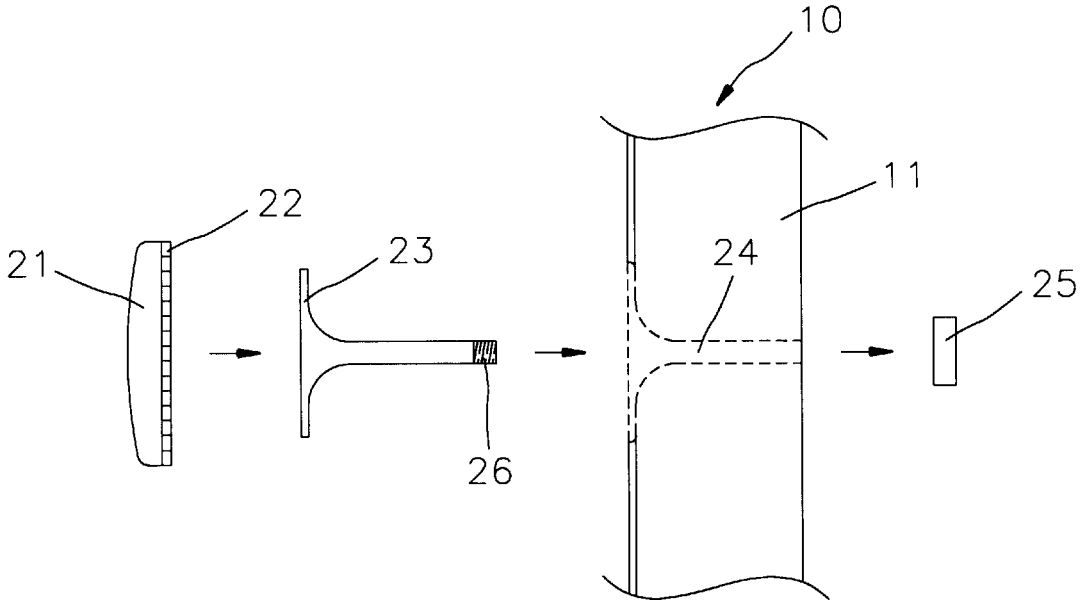
FIGS. 1 and 2 show an exploded elevational view and a sectional elevational view of a first embodiment in accordance with the present invention, respectively.
Figure 2:
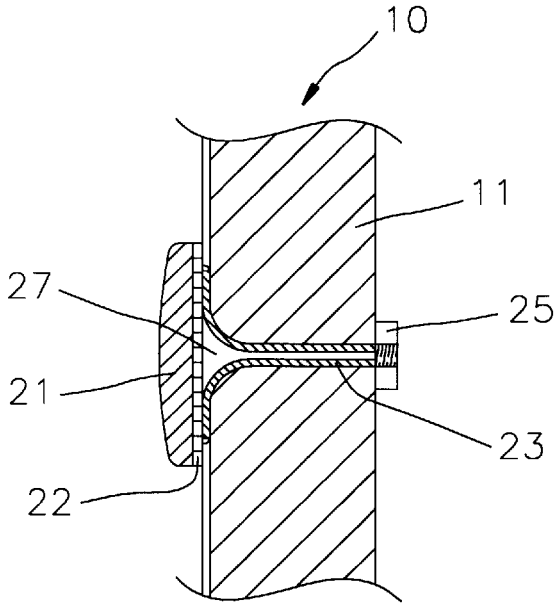

There is shown in FIGS. 1 and 2 the first embodiment of the present invention. As shown, the inventive temperature checking system frontally mounted on a refrigerator 10 includes a heat insulation plate 21, a thermochromic member 22, a tubular member 23 and a tube fixing member 25. For installing these components on the refrigerator 10, a receiving-hole 24 is formed through a wall of the refrigerator 10, preferably through a door 11 of the refrigerator 10.

The heat insulation plate 21 is positioned outmost in the temperature checking system and is transparent enough for the user or the operator to know a color change of the thermochromic member 22. The heat insulation plate 21 is fixed on an external surface of the door 11 of the refrigerator 10 by, e.g., an adhesive, to thereby enclose the thermochromic member 22 from an ambient air. The heat insulation plate 21 constructed in this manner serves to prevent a heat transfer from the ambient air to an inside of the refrigerator 10 through the thermochromic member 22, when the thermochromic member 22 is exposed to an internal air of the refrigerator 10.

Figure 3:
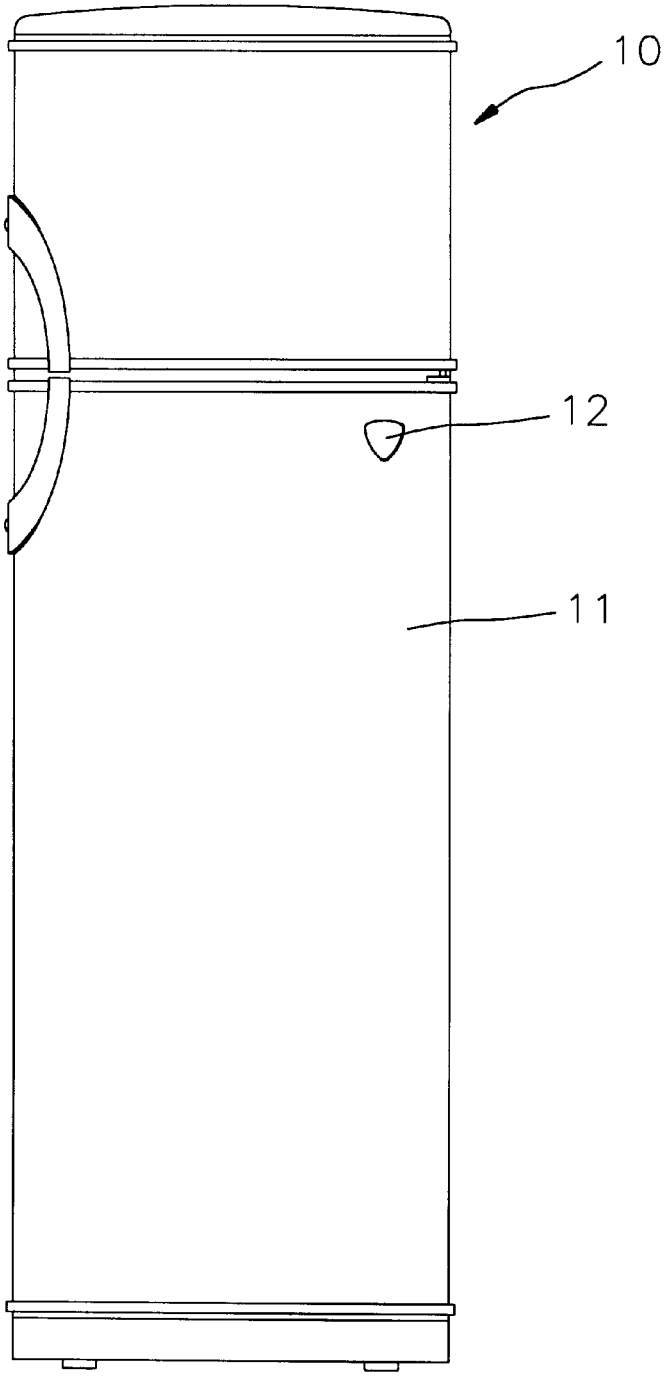
FIG. 3 illustrates a frontal view of the refrigerator.

The thermochromic member 22 is fixed on an inner surface of the heat insulation plate 21 via, e.g., an adhesive or the like, and is of a thermochromic material subjected to a color change when it is exposed to an ambient condition of a particular range of the temperature. As shown in FIG. 3, it is preferable that the thermochromic member 22 additionally serves to show an emblem or a trade mark of the manufacturer. In the first embodiment, the thermochromic member 22 is set to be responsive to a temperature of 10° C.

Inserted into the receiving-hole 24 of the door 11 is the tubular member 23 serving as a path through which the internal air of the refrigerator 10 can reach the thermochromic member 22. When the tubular member 23 is positioned into the receiving hole 24, as shown in FIG. 2, one end of the tubular member 23 protrudes out of the door 11 to be exposed to an internal space of the refrigerator 10, with the other end being contacted with the thermochromic member 22. Through a duct 26 formed through the tubular member 23, the internal air of the refrigerator 10 is transferred to the thermochromic member 22. In accordance with the first embodiment of the present invention, a cross-section of the end adjacent to the thermochromic member 22 of the duct 26 is greater than that of the end exposed to the internal air. As a result, the thermochromic member 22 becomes exposed to the cooled internal air at its widen surface, allowing the thermochromic member 22 to quickly respond to the temperature change of the internal air.

On the other hand, the tubular member 23 has a male screw portion 26 formed around at the end exposed to the cooled internal air. By engaging the male screw portion 26 and a female screw portion of the tube fixing member 25, the tubular member 23 is installed on the door 11.

Figure 4:
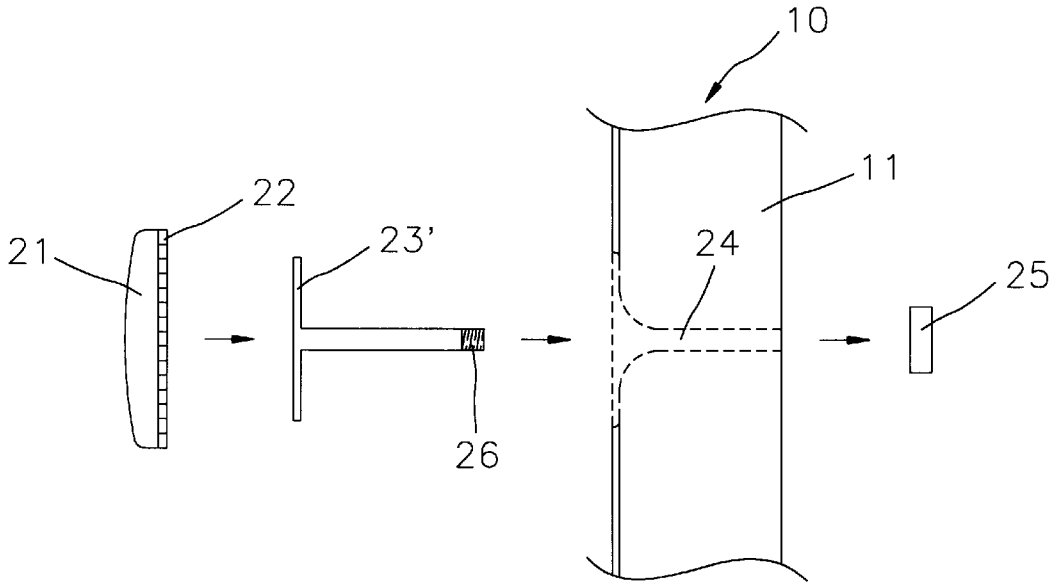
FIGS. 4 and 5 offer an exploded elevational view and a sectional elevational view of a second embodiment in accordance with the present invention, respectively.
Figure 5:
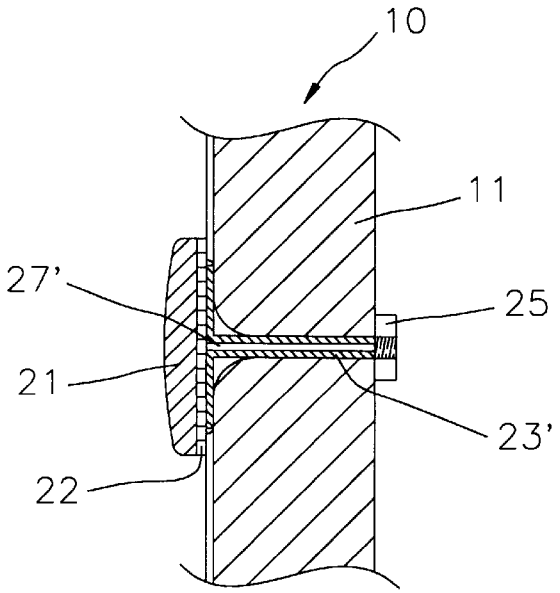

The second embodiment of the present invention is shown in FIGS. 4 and 5. Furthermore, same reference numerals will be used to represent same components in FIGS. 1 and 2.

As shown in FIGS. 4 and 5, a tubular member 23' is used in the second embodiment of the present invention. The tubular member 23' has a capillary type duct 26' of a constant diameter along the entire length thereof. This allows the thermochromic member 22 to become exposed to the cooled internal air at relatively narrow surface thereof, resulting in a reduction of the heat loss through the thermochromic member 22 to the ambient air. Further, it is preferable that the tubular member 23' be gilt with a bronze.

Figure 6:
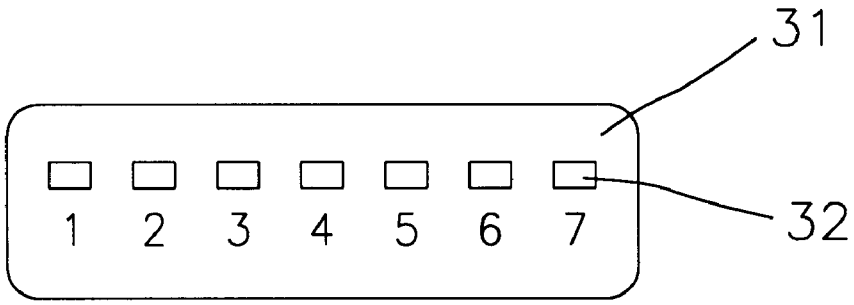
FIGS. 6 and 7 depict an elevational view and a top plan view of a thermochromic member employed in the present invention.
Figure 7:
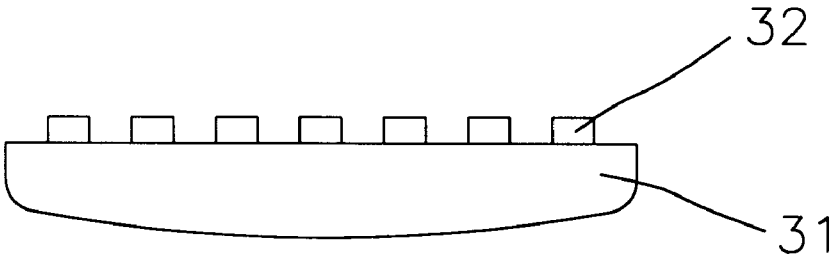

On the other hand, there is shown in FIGS. 6 and 7 the modification of the thermochromic member employed in the present invention. As shown, a plurality of thermochromic members 32 are attached to a heat insulation plate 31. The heat insulation plate 31 is of a material having a transparent characteristic and a heat insulating characteristic; and each of the plurality of thermochromic members 32 has a different level of responsive temperature from one another. That is, each of the plurality of thermochromic members 32 is only responsive to one of a spectrum of different temperature ranges. Accordingly, when the thermochromic members 32 are exposed to the cooled internal air of the refrigerator 10, only one member of the plurality of thermochromic members 32 changes its color depending upon the temperature of the internal air. A series of numbers is indicated below the thermochromic members 32 as shown in FIG. 6, in addition to the described configuration to allow a digitized display of the internal temperature of the refrigerator 10.

The inventive temperature checking system allows the user to know the internal temperature of the refrigerator 10 without requiring a separate and complicated mechanism including a sensor or the like. Moreover, in an assembling line of the refrigerator, examine processes for checking inferior goods may be simplified, since it allows an easy determination of whether or not the assembled refrigerator is normally operating.

Although the invention has been shown and described with respect to the preferred embodiments, it will be understood by those skilled in the art that various changes and modifications may be made without departing from the spirit and scope of the invention as defined in the following claims.

What is claimed is:

1. A system for checking an internal temperature of a refrigerator comprising:

a thermochromic member positioned on an external surface of the refrigerator;

a heat transfer means for serving as a path for a heat transfer between said thermochromic member and an internal air of the refrigerator; and a transparent heat insulation plate enclosing said thermochromic member from an ambient air to prevent a heat transfer from said ambient air into said internal air of the refrigerator through said thermochromic member.

2. The system of claim 1, wherein an emblem of a manufacturer of the refrigerator is indicated on the thermochromic member.

3. The system of claim 1, wherein said thermochromic member is of a plurality of thermochromic members aligned with one another, each of the thermochromic members having a different level of responsive temperature from one another.

4. The system of claim 1, wherein said heat transfer means comprises:

a receiving hole formed through a wall member of said refrigerator; and a tubular member inserted into said receiving hole, one end of said tubular member positioned inside the refrigerator and the other end being contacted with said thermochromic member, the tubular member having a duct formed therethrough, wherein a cross section of an end being contacted with the thermochromic member of said duct is larger than that of an end being positioned inside the refrigerator of the duct.

5. The system of claim 1, wherein said heat transfer means comprises:

a receiving hole formed through a wall member of said refrigerator; and a tubular member inserted into said receiving hole, one end of said tubular member positioned inside the refrigerator and the other end being contacted with said thermochromic member, the tubular member having a duct with a constant diameter along an entire length of said tubular member.

6. The system of claim 4, wherein said wall member of the refrigerator is a door of the refrigerator.

7. The system of claim 4, wherein said heat transfer means further comprises a tube fixing means for fixing the tubular member in the refrigerator.

8. The system of claim 5, wherein said wall member of the refrigerator is a door of the refrigerator.

9. The system of claim 5, wherein said heat transfer means further comprises a tube fixing means for fixing the tubular member in the refrigerator.

10. The system of claim 5, wherein said tubular member is gilt with a bronze.

11. The system of claim 7, wherein said tube fixing means comprises:

a male screw portion formed around said end positioned inside the refrigerator of the duct; and a tube fixing member having a female screw portion for being engaged with said male screw portion.

12. The system of claim 9, wherein said tube fixing means comprises:

a male screw portion formed around said end positioned inside the refrigerator of the duct; and a tube fixing member having a female screw portion for being engaged with said male screw portion.

* * * * *